US006790246B1

(12) United States Patent
Nilsson

(10) Patent No.: US 6,790,246 B1
(45) Date of Patent: Sep. 14, 2004

(54) APPARATUS FOR GASIFICATION OF SPENT LIQUOR

(75) Inventor: Bengt Nilsson, Skoghall (SE)

(73) Assignee: Chemrec Aktiebolag, Stockholm (SE)

( * ) Notice: Subject to any disclaimer, the term of this patent is extended or adjusted under 35 U.S.C. 154(b) by 0 days.

(21) Appl. No.: 09/937,658

(22) PCT Filed: Mar. 28, 2000

(86) PCT No.: PCT/SE00/00596

§ 371 (c)(1),
(2), (4) Date: Nov. 2, 2001

(87) PCT Pub. No.: WO00/60163

PCT Pub. Date: Oct. 12, 2000

(30) Foreign Application Priority Data

Apr. 1, 1999 (SE) ..... 9901186

(51) Int. Cl.[7] ..... D21C 11/12
(52) U.S. Cl. ..... 48/61
(58) Field of Search ..... 422/185, 187, 422/198, 202, 227, 228, 239; 48/61, 62 R, 67, 69; 162/30.1, 31

(56) References Cited

U.S. PATENT DOCUMENTS 4,808,264 A * 2/1989 Kignell ..... 162/30.1
5,407,455 A * 4/1995 Nilsson ..... 48/61
5,752,994 A * 5/1998 Monacelli et al. ..... 48/111
6,113,739 A * 9/2000 Nilsson ..... 162/30.1

FOREIGN PATENT DOCUMENTS

WO WO 9535410 A1 12/1995

* cited by examiner

*Primary Examiner*—Samuel M. Heinrich
(74) *Attorney, Agent, or Firm*—Jeffrey S. Melcher; Manelli Denison & Selter, PLLC

(57) ABSTRACT

Arrangement for understoichiometric gasification of spent liquor from chemical pulp production, comprising an upper reactor part (2), which upper reactor part is provided with a burner (5) for the spent liquor and with an internally clad reactor jacket (4), and a lower separating part (8), comprising at least one wall (18), for separating a phase of solid and/or molten material, formed on gasification, from a phase of combustible gaseous material, which separating part (8) is arranged to essentially convey the said phase of solid and/or molten material to a product liquid bath (11). According to the invention, the said separating part (8) also comprises means for creating a cooling and protecting liquid film along at least one side of the said wall (18), the said means comprising a supply line (19) for coolant liquid, which supply line, at its inlet end, is connected to a coolant liquid bath (10) which is separate from the said product liquid bath (11).

11 Claims, 1 Drawing Sheet

APPARATUS FOR GASIFICATION OF SPENT LIQUOR

TECHNICAL FIELD

The present invention relates to an arrangement for understoichiometric gasification of spent liquor from chemical pulp production, comprising an upper reactor part, which upper reactor part is provided with a burner for the spent liquor and with an internally clad reactor jacket, and a lower separating part, comprising at least one wall, for separating a phase of solid and/or molten material, formed on gasification, from a phase of combustible gaseous material, which separating part is arranged to essentially convey the said phase of solid and/or molten material to a product liquid bath. The arrangement is principally intended for use in conjunction with the recovery of energy and chemicals from an expended cooking liquor from production of chemical paper pulp from a material containing lignocellulose.

PRIOR ART AND PROBLEMS

For many years, the commercially dominant process for recovering energy and chemicals from so-called black liquor, which has been obtained in paper pulp production by the sulphate method, has generally been the so-called Tomlinson process, in which a so-called recovery boiler is used.

A more modern process is described in Swedish patent SE-C-448,173, which process is based on understoichiometric gasification/pyrolysis (i.e. with an oxygen deficit) of the black liquor in a reactor. The products are in this case a phase of solid and/or molten material, essentially comprising sodium carbonate, potassium hydroxide and sodium sulphide, and an energy-rich, combustible gas phase, essentially comprising carbon monoxide, carbon dioxide, methane, hydrogen gas and hydrogen sulphide. The mixture of solid/molten phase and gas phase is cooled and separated in a separating part connected to the reactor by means of direct contact with green liquor, the solid/molten phase dissolving in the green liquor. The green liquor is then conveyed for conventional causticizing for production of white liquor. The gas phase is used as fuel for generating steam and/or electrical power.

Other known reactors of the same type as in SEC-448,173 are disclosed, for example, in WO94/20677, WO93/0229 and WO93/24704. The separating part is usually arranged so that its outer walls constitute a continuation of an outer wall of the reactor, a constriction being present between the reactor and the separating part. The constriction, which usually has the shape of a truncated cone, bears a ceramic lining in the reactor. In connection with the constriction, there is also usually a downpipe with some form of cooling ring, which is arranged to spray water or green liquor into the flow of solid/molten material and gas from the reactor. The solid/molten material in the flow from the reactor is dissolved in the water or the green liquor.

It is known from WO95/35410 to use returned green liquor to create a thin wetting film on the inside of a downpipe at the outlet from the reactor.

It has been found that previously known constructions of the separating part, with its cooling ring, and of the transition between the reactor and the separating part entail a number of relatively serious problems. Thus, for example, thermal stresses arise in both the cooling ring and in the ceramic lining. The substantial constriction between reactor and separating part also leads to a turbulent flow in which smelt droplets recirculate to the lining and cooling ring. A related problem is that the cooling ring is very exposed to corrosion on account of the action of hot smelt, which can lead to cracks and leakage in the cooling ring, which in turn can cause very serious damage to the ceramic lining. Another problem is that of avoiding absorption of the gas phase, especially its carbon dioxide content, in green liquor formed. In such absorption, there is an undesired increase in the carbonate content and also hydrogen carbonate. For this reason, it is not advantageous to wet the inside of the downpipe with green liquor.

DESCRIPTION OF THE INVENTION

The object of the present invention is to reduce or eliminate the abovementioned problems by making available an arrangement for understoichiometric gasification of spent liquor from chemical pulp production which has an improved design of the transition between reactor and separating part. According to the invention, the cooling ring can be dispensed with, while the separating part is cooled efficiently and in a corrosion-inhibiting manner, and yet absorption of carbon dioxide in the green liquor formed is to the greatest possible extent avoided. According to one aspect of the invention, the transition is made essentially without constriction, creating conditions for a laminar outlet flow from the reactor.

The arrangement according to the invention is defined in Patent claim 1.

According to the invention, the arrangement for gasification of spent liquor comprises means for creating a cooling and protective film along at least one side, preferably the inside, of a wall for the separating part, the said means comprising a supply line for coolant liquid, which supply line, at its inlet end, is connected to a coolant liquid bath. The coolant liquid bath preferably consists of a condensate bath and is separate from a product liquid bath, i.e. separate usually from a green liquor bath.

The upper reactor part with ceramic lining is connected to a lower separating part cooled by a film of liquid, in which separating part smelt and combustion gas are separated. However, a considerable number of the reactions also take place in the separating part, which affords an extended reaction space. In the following description, however, this lower part is referred to only with respect to the separating stage.

According to one aspect of the invention, the coolant liquid film, the supply line and the coolant liquid bath are included in one circulation, the coolant liquid bath preferably consisting of a condensate bath through which the gas phase produced on gasification is bubbled.

According to another aspect of the invention, all or almost all the steel surfaces in the separating part are provided with liquid contact in the form of a liquid film or in the form of an adjoining liquid bath.

According to yet another aspect of the invention, the transition between reactor part and separating part is designed such that the constriction between them has an open area of at least 40% of the greatest internal area of the reactor part in the horizontal plane. The reactor part and its lining are connected to the upper end of the separating part, which is directly or indirectly cooled by the said coolant liquid film. In this way, the conventional bottom cone in the reactor can be largely dispensed with, and at the same time the conventional cooling ring is avoided.

According to yet another aspect of the invention, the lower part of the lining is formed with a self-supporting construction made of ceramic material stable against thermal shock.

According to a further aspect of the invention, the reactor operates at a pressure of 1.5–150 bar (abs.), preferably 1.5–50 bar, although atmospheric pressure is also conceivable. The temperature in the reactor can be 500–1600° C., preferably 700–1300° C.

DESCRIPTION OF THE FIGURE

The invention will be described below on the basis of a preferred embodiment and with reference to FIG. 1 which shows an arrangement according to the said embodiment.

Figure 1:
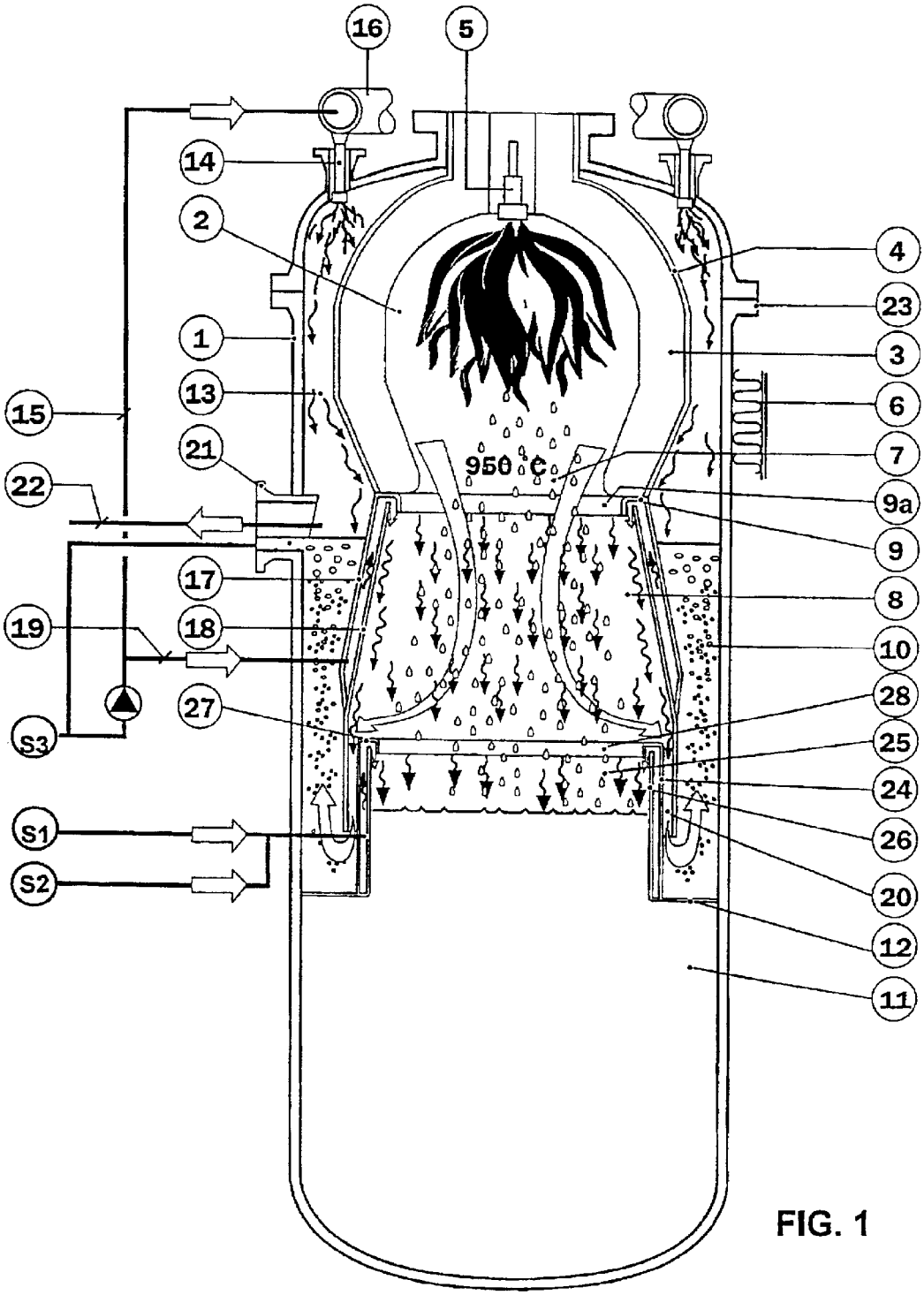
FIG. 1 shows a pressure vessel 1 made of pressure-vessel steel and adapted for a pressure of 35 bar at a maximum temperature of about 280° C. There is an insulation 6 covering the pressure vessel 1. Arranged inside the pressure vessel 1 there is an upper reactor part 2 which consists of a cassette 4 of sheet metal, with a ceramic lining 3.

A burner 5 for black liquor is arranged at the top of the reactor part 1, connected to inlets (not shown) for black liquor and oxygen gas and/or another oxygen-containing gas such as air. The reactor part has, at the bottom, an opening 7 which preferably has an open area of at least 40% of the greatest internal area of the reactor part in the horizontal plane. The separating part 8 is connected to the reactor part at the opening 7. Arranged outside the separating part 8 there is a coolant liquid bath 10, hereinafter referred to as the condensate bath. In the embodiment shown, the condensate bath 10 is accommodated in the same vessel 1 as the reactor part 2, the separating part 8 and a product liquid bath 11, hereinafter referred to as the green liquor bath. In the embodiment shown, the green liquor bath 11 lies partially under the condensate bath 10, these baths being separated by a horizontal dividing wall 12.

There is a gap 13 between the pressure vessel 1 and the jacket of the reactor part 2. In this gap 13, the pressure is essentially the same as in the reactor, namely 35 bar, and the temperature is about 240° C., which corresponds to the saturation temperature at 35 bar. Connected to the gap there is an inlet 14 for a coolant medium, in the embodiment shown a coolant liquid which consists of condensate from the condensate bath 10. This coolant liquid is supplied to the gap 13 via a supply line 15 with a pump, ending in an annular line 16 with a number of outlets 14.

The condensate bath 10 has a liquid surface which preferably lies under the lower part of the reactor part 2. According to the invention, condensate from the condensate bath 10 is also used for cooling the separating part 8, with condensate being supplied to the separating part 8, more precisely to the intermediate space between two concentric cylindrical plates 17, 18 of upwardly narrowing cross section, via a second supply line 19 which is in communication with the supply line 15. A countercurrent condenser (not shown) can advantageously be arranged in the connection between the lines 15 and 19, belonging to a subsequent operational stage for gas cooling. The condensate fills the space between the two plates 17, 18 and, via a spillway, forms a liquid film on the inside of the inner plate 18, after which it flows back out into the condensate bath 10. In the figure, S3 denotes a compensating tank for the condensate 10 which runs over the spillway 21.

The ceramic lining 3 of the reactor part 2 is supported at the lower edge by brackets (not shown) fixed to the pressure vessel or to some part of the upper edge 9 of the separating part 8. In the embodiment shown, the upper edge 9 of the separating part constitutes an inwardly angled continuation of the outer cylindrical plate 17, this plate 17 extending a distance further up than the plate 18. The edge 9 and its downwardly directed end collar 9A are also cooled by the condensate which flows between the plates 17 and 18 and along the edge 9 and the collar 9A over the upper end of the plate 18, thereafter continuing as a liquid film along the inside of the plate 18.

As an alternative to the embodiment shown, one or more further concentric cylindrical plates of upwardly narrowing cross section can be arranged in conjunction with the two plates 17 and 18. In this case, a spillway of the same type as the one described above can be arranged so that a liquid film of condensate is also formed on the outside of the outermost plate. Another possible alternative is that the outer plate 17 shown in the figure has openings at its transition with the edge 9, and condensate is able to flow out of these openings in order to form a liquid film on the outside of the plate 17.

According to the embodiment, the separating part also has a lower part 25 which separates the condensate bath 10 from the green liquor bath 11. This lower part comprises a cylindrical wall 26 which is cooled by means of liquid from the green liquor bath 11, this wall being arranged so that the green liquor is made to flow over a spillway in order to form a liquid film along the inside of the wall 26. The cylindrical wall 26 is in this case lined by a second cylindrical wall 24, and green liquor from the green liquor bath 11 is supplied to the space between these two cylindrical plates and then flows over the upper edge of the inner plate 26 and along its inside. The cylindrical wall 24 extends a short distance further up than the wall 26 and has at the top an inwardly angled edge 27 and a collar 28 directed down from this edge. The green liquor bath 11, or at least its upper part with its surface, is accommodated inside the lower part 25 of the separating part. The surface can be protected, if appropriate, by a layer of inert gas, for example nitrogen gas, or with propane, etc. As is indicated in the figure, the space between the walls 24 and 26 is thus supplied with a flow from two sources S1 and S2. The one source Sl can consist of the green liquor bath 11 and the other source S2 can consist of a vessel containing inert gas, which inert gas is mixed into the flow with the green liquor. In this way, no separate supply of inert gas is needed.

As an alternative to the illustrated embodiment of the lower part 25 of the separating part, it is also possible to supply condensate here, instead of or in addition to the green liquor, in order to form the coolant liquid film. Another alternative is that condensate is supplied to the space between the walls 24 and 26, and the edge 27 and the collar 28 are arranged outwards and downwards, respectively, from the inner wall 26, so that the condensate is also made to form a liquid film on the outside of the wall 24.

A further possible alternative is for one or more further cylindrical concentric walls to be provided, with condensate being made to form a liquid film on the outside of the outermost wall, while green liquor is made to form a liquid film on the inside of the innermost wall.

The actual gasification process is known per se and will not be described in detail, but the principle is that black liquor is gasified in the reactor part 2, at a pressure of 35 bar and at a temperature of about 950° C., with formation of a phase of solid and/or molten material and a gas phase of combustible material. The solid/molten phase falls straight down into the green liquor bath 11 under its own weight and is dissolved there, while the gas phase is forced out into a gap 20 between the downward extension of the plate 18, or 17, and the inwardly lying cylindrical wall 24 which, at the lower edge, is joined in a sealed manner to the dividing wall 12. The green liquor bath 11 lies to the inside of the cylindrical wall 24 and under the dividing wall 12. Contact is as far as possible avoided between gas phase and green liquor bath. The gas phase continues through the gap 20 and is then forced to bubble through the condensate bath 10, whereupon any particles entrained in the gas are dissolved in the condensate and the gas is thus washed and saturated with moisture. The hot, humidified gas then reaches the gap 13 and is then drawn through an outlet 21 in the pressure vessel 1. In the embodiment shown, there is a common outlet 21 for gas and recirculating condensate. In an alternative embodiment, separate outlets can be provided, in which case a gas outlet can be arranged in or at the upper part of the pressure vessel 1. The gas passes via a line 22 onwards for energy recovery in the form of steam and/or electrical power (gas and steam turbine) and condensate passes via the supply lines 15, 19 back to the arrangement for cooling.

The invention is not limited to the embodiment described above, and can be modified within the scope of the attached patent claims. For example, the arrangement can be used in understoichiometric gasification of spent liquors other than conventional black liquor, for example spent sulphite liquors, spent bleaching liquors or black liquor with potassium base. In addition, the green liquor bath can be replaced by a white liquor bath when the process is designed to avoid causticizing and instead directly produce a white liquor with high sulphidity, for example according to WO91/08337 or EP 617 747.

The principle for cooling the separating part can of course also be used in connection with a reactor which is not liquid-cooled.

The separating part can also be designed with spray elements which are arranged to spray condensate in for cooling the product mixture of molten/solid phase and gas phase. By means of such spray elements, an even and favourable temperature profile, without any sudden temperature transitions, can be created from the reactor right down to the green liquor bath.

The condensate bath 10 does not necessarily have to the accommodated in the vessel 1 but can be arranged in a separate vessel, for example according to WO95/35410, where the gas phase is driven from the reactor outlet to a counter-current falling-film condenser with a condensate bath in the lower part, through which condensate bath the gas is forced to bubble. The coolant liquid in the liquid film on the plate 18 can in this case be collected at the lower edge of the plate and then conveyed to the condensate bath in the separate vessel. The arrangement according to the invention can also be designed such that the gas is not allowed to bubble through the condensate bath.

The invention can also be used in conjunction with a system of two or more reactors, in which case any condensate movement/coolant liquid movement can be coordinated in an optimum manner. It will also be appreciated that the separating part and green liquor bath can be designed in other ways without departing from the concept of the invention.

In its widest aspect, the coolant liquid does not need to consist of a condensate in the system, as long as Patent claim 1 is satisfied, the problems set out in the list of problems defined hereinabove being reduced or eliminated. The coolant liquid can also consist of used cooking liquor, i.e. thin liquor/black liquor.

What is claimed is:

1. Arrangement for understoichiometric gasification of spent liquor from chemical pulp production, comprising an upper reactor part (2), which upper reactor part is provided with a burner (5) for the spent liquor and with an internally clad reactor jacket (4), and a lower separating part (8), comprising at least one wall (18), for separating a phase of solid and/or molten material, formed on gasification, from a phase of combustible gaseous material, which separating part (8) is arranged to essentially convey the said phase of solid and/or molten material to a product liquid bath (11), characterized in that the said reactor part (2) has a transition to the separating part (B), which transition has an open area of at least 40% of the greatest internal area of the reactor part in the horizontal plane, the said separating part (8) also comprising means for creating a cooling and protecting liquid film along at least one side of the said wall (18), the said means comprising a supply line (19) for coolant liquid, which supply line, at its inlet end (21), is connected to a coolant liquid container (10) which is separate from the said product liquid bath (11).

2. Arrangement according to claim 1, characterized in that the coolant liquid container consists of a condensate bath for coolant liquid arranged outside the separating part (8), but inside an outer vessel (1), preferably a pressure vessel.

3. Arrangement according to claim 1, characterized in that the coolant liquid container consists of an accumulator tank for thin liquor/black liquor obtained from subsequent recovery systems or after use of white liquor in the cooking process in pulp production.

4. Arrangement according to claim 2, characterized in that from the said coolant liquid bath (1) or from the said supply line (19) there is also a second supply line (15) which is designed to convey the same coolant liquid to a gap (13) between the said upper reactor part (2) and an outer vessel (1), preferably a pressure vessel, which surrounds the reactor part (2), for cooling the reactor part (2).

5. Arrangement according to claim 2, characterized in that at least a part of the coolant liquid in the said coolant liquid film is arranged to be conveyed from the wall (18) back to the coolant liquid bath (10).

6. Arrangement according to claim 5, characterized in that the said coolant liquid bath (10) is at least partially arranged in a space between the said separating part (8) and an outer vessel (1), preferably a pressure vessel, the wall (18) being arranged so that the coolant liquid in the said coolant liquid film flows down in the said coolant liquid bath (10), and an outlet (21) for the coolant liquid from the coolant liquid bath is preferably arranged in the said outer vessel (1) at a level which preferably lies under the reactor part (2).

7. Arrangement according claim 1, characterized in that the said phase of combustible gaseous material is arranged to be conveyed from the said upper reactor part (2), via the said lower separating part (8), through the said coolant liquid bath (10), or through a spray curtain of coolant liquid which is collected in the said coolant liquid bath (10).

8. Arrangement according claim 1, characterized in that the said separating part (8) also comprises a second wall (17), the wall (18) being lined by the said second wall (17) so that a space is formed between the wall (18) and the second wall (17), which space is arranged to be supplied with coolant liquid via the supply line (19), and the walls (17, 18) being arranged so that the coolant liquid is made to flow over a spillway in order to form the said coolant liquid film along at least one side of the wall (18).

9. Arrangement according claim 1, characterized in that the separating part (8) also comprises a lower part (25) with a third wall (26), which third wall is coolled by means of liquid in/from the said product liquid bath (11), the said third wall (26) preferably being arranged such that the liquid is made to flow over a spillway in order to form a liquid film along at least one side of the said third wall.

10. Arrangement according claim 1, characterized in that an upper end (9) of the separating part (8) adjoins and at least partially supports the reactor part (2), as a result of which a lining (3) of the reactor part also adjoins the said upper end of the separating part.

11. Arrangement according to claim 9, characterized in that the said means for creating the said coolant liquid film is arranged to also cool the upper adjoining end (9) of the separating part (8).

* * * * *